US005080723A

United States Patent [19]

Kaup et al.

[11] Patent Number: 5,080,723

[45] Date of Patent: Jan. 14, 1992

[54] PROCESS AND DEVICE FOR RECOVERING THE ENAMEL SLIMES IN ELECTRO-IMMERSION ENAMELING PLANTS

[75] Inventors: Friedel Kaup, Guetersloh; Heinrich Warnke, Wedekingring, both of Fed. Rep. of Germany

[73] Assignee: Miele & Cie GmbH & Co., Gutersloh, Fed. Rep. of Germany

[21] Appl. No.: 454,519

[22] Filed: Dec. 21, 1989

[30] Foreign Application Priority Data

Dec. 24, 1988 [DE] Fed. Rep. of Germany ..... 3843953

[51] Int. Cl.[5] ..... B08B 3/32

[52] U.S. Cl. ..... 134/34; 204/180.8; 204/180.4; 204/181.5

[58] Field of Search ..... 134/34; 204/180.8, 180.4, 204/181.5

[56] References Cited

U.S. PATENT DOCUMENTS 2,935,231 2/1958 Paull et al. ..... 222/94

3,663,403 5/1972 Christenson et al. ..... 204/180.8

FOREIGN PATENT DOCUMENTS 2313751 10/1974 Fed. Rep. of Germany ... 204/180.8

2736479 3/1978 Fed. Rep. of Germany ... 204/180.8

0207200 12/1982 Japan ..... 208/180.8

1360970 of 1774 United Kingdom ..... 204/180.8

1373579 11/1974 United Kingdom ..... 208/180.8

*Primary Examiner*—Asok Pal

*Attorney, Agent, or Firm*—Collard, Roe & Galgano

[57] ABSTRACT

In electrophoretic immersion enameling, about one-third of the enamel slimes charged is admitted into the rinsing basin, with this basin being located downstream of the immersion enameling basin. The process and the device for carrying out the process of the invention effect an efficient recovery of the enamel slimes. In the process, the electro-immersion enameled parts are wholly or partly sprayed off above the immersion enameling basin and/or an after-connected additional basin. The overall water system is kept constant by draining cells arranged and integrated into the immersion enameling basin or in the additional basin.

4 Claims, 1 Drawing Sheet

PROCESS AND DEVICE FOR RECOVERING THE ENAMEL SLIMES IN ELECTRO-IMMERSION ENAMELING PLANTS

BACKGROUND OF THE INVENTION

1. Field Of The Invention

The invention relates to a process for recovering the enamel slimes in electro-immersion enameling plants with a basin for electrophoretic immersion enameling (EIE-basin) and with at least one rinsing basin located in the down-stream direction of the process.

2. The Prior Art

In electrophoretic immersion enameling, which is referred to by the abbreviation "EIE", about one third of the enamel slimes used are, as a rule, charged in the rinsing basin, which follows the EIE-basin in the process sequence. Primarily for cost reasons, this rinsed off enamel has to be recovered and returned into the process. Processes for the recovery of the enamel slimes are known from DE-Al-34 33 576 and DE-Al-31 21 604. For these purposes, DE-Al-34 33 576 describes a process and device for the recovery of the enamel slimes in which the coated part, upon leaving the EIE-basin, is directly transported into a rinsing basin downstream. The rinsing basin is equipped with an agitator which moves the rinsing water into forced flow, such that a portion of the rinsing water is sent into a settling zone with a reduced flow rate, whereupon the settling enamel is transported back into the EIE-basin.

The drawback of the known process and device lies basically in the fact that the slimes resulting from the recovered enamel have properties different from those of the slimes present in the coating basin. In particular the conductivity, pH, density and the content of auxiliary substances, among others, are different, with the consequence that a compensation is required in order to be able to reuse the recovered slimes. In this connection, one problem is that the ratio between the electrically deposited quantity of enamel and the quantity of enamel brought into the rinsing bath is not always constant. This lack of constancy is caused, for example, by the fact that parts in the bath have highly varying drawing capacities.

SUMMARY OF THE INVENTION

It is an object of the present invention to provide a process and device for recovering the enamel slimes in EIE-plants, in which the major part of the enamel charged can be used again, as reusable material, and in which the initial admission of enamel slimes into the first rinsing bath is kept to a minimum.

The above object is accomplished in accordance with the present invention by providing a process for recovering the enamel slimes in electro-immersion enameling plants having a basin zone for electrophoretic immersion enameling (EIE-basin) of electro-immersion enameled parts and having an additional basin zone connected downstream in the process sequence, comprising at least partly spraying off the electro-immersion enameled parts above the EIE-basin zone or above the additional basin zone; and maintaining constant the water content of the EIE-basin by draining cell zones integrated in the EIE-basin zone or arranged in the additional basin zone.

A device for recovering the enamel slimes in electro-immersion enameling (EIE) plants for producing electro-immersion enameled parts comprises an EIE basin; a first rinsing basin; an additional basin having draining cells and located between the EIE-basin and the first rinsing basin; a spraying system installed above the EIE-basin; and means for connecting the additional basin with the EIE-basin comprising an overflow means and a recycling system for the enamel slimes.

The process and device according to the invention each have the special advantage that the enamel slimes detaching themselves from the coated part, and passing into the rinsing basin, are highly reduced, so that costly treatment measures in the rinsing basin can be eliminated. Furthermore, the properties of the slimes used are stabilized. In addition, the content of interfering ions in the coating system is reduced; and it is possible to enhance the coating efficiency of the so-called Faraday cages as a whole.

BRIEF DESCRIPTION OF THE DRAWINGS

Other objects and features of the present invention will become apparent from the following detailed description considered in connection with the accompanying drawing which discloses two embodiments of the present invention. It should be understood, however, that the drawing is designed for the purpose of illustration only and not as a definition of the limits of the invention.

In the drawing, the FIGURE shows a schematic flow chart for the treatment zones of an electrophoretic immersion enameling plant with a rinsing bath located downstream.

DETAILED DESCRIPTION OF THE PREFERRED EMBODIMENTS

Figure 1:
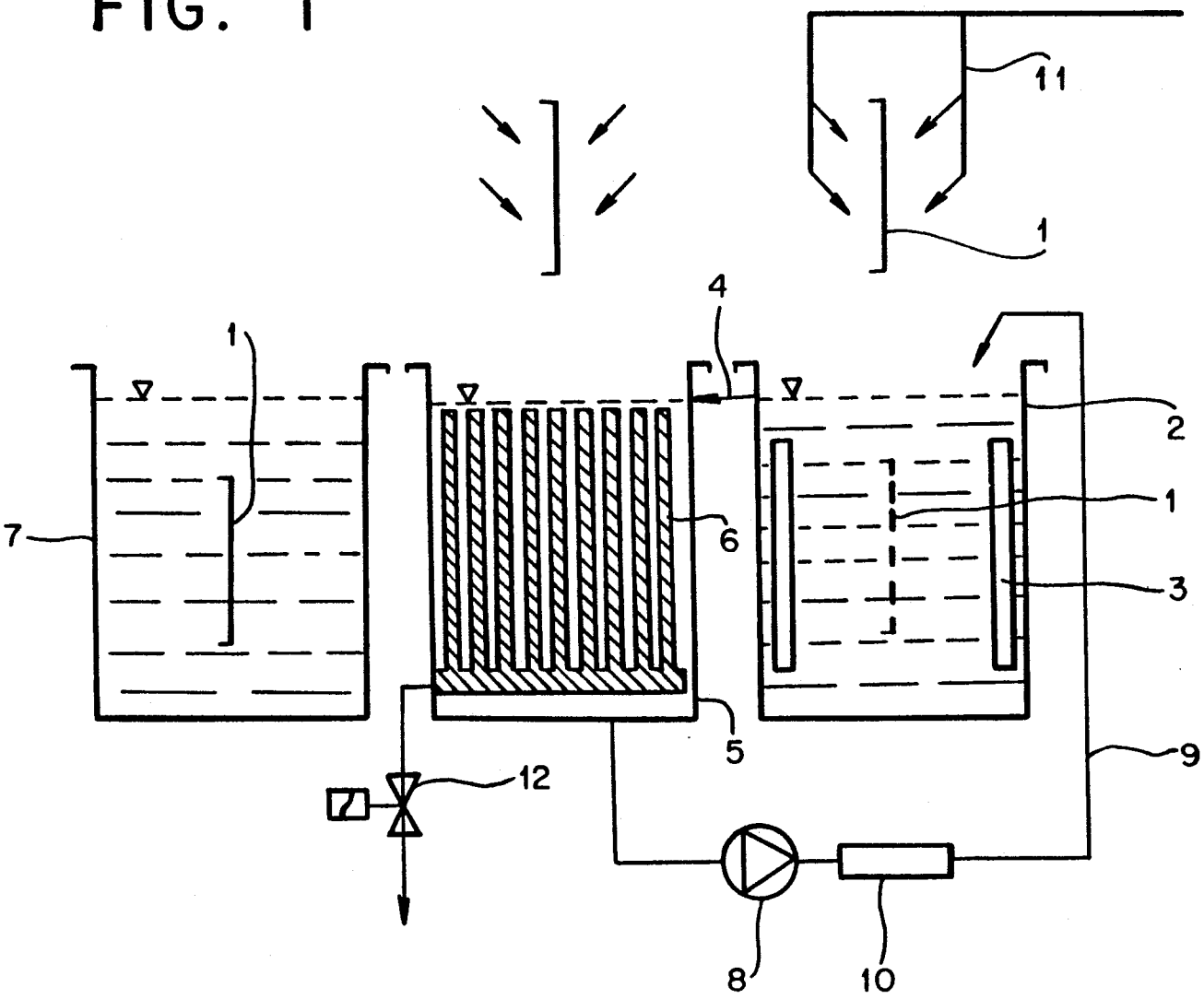

In the electrophoretic enameling process, the part 1 to be coated is immersed in the EIE-basin 2. The cathodes 3 are positioned in the EIE-basin 2.

The EIE-basin is connected to an additional basin 5 by way of an overflow 4. The draining cells 6, which are also referred to as migration cells, are arranged in the additional basin 5. The first rinsing basin 7 is connected downstream of the additional basin 5.

The additional basin 5 is also connected to the EIE-basin 2 by way of a recycling system for the enamel slimes in general and specifically for the recovered enamel slimes. The recycling system basically includes a pump 8, which returns the pumpable enamel slimes to the EIE-basin 2 by way of suitable transporting conduits 9. The density of the enamel slimes is monitored and adjusted, if need be, via a density meter 10 positioned in the transport passageway conduits 9.

A spray-off device 11 is installed on top of the EIE-basin 2, by means of which desalted water can be sprayed onto the parts 1 to be coated. After spraying off the part 1, the latter is transported over the additional basin 5, where the part can be sprayed off further with desalted water, if need be. Subsequently, the part 1 is immersed in the rinsing basin 7.

The mode of operation of the apparatus shown in the drawing is described as follows. So that hardly any enamel slimes can pass into the rinsing basin, which slimes adhere to the electrically deposited enamel coating only by forces of adhesion, the part 1 is rinsed off with desalted water as it is being removed from the EIE-basin 2. The loosely adhering enamel runs back into the EIE-basin 2 together with the spray water. By using desalted water, the conductivity in the EIE-basin 2 is lowered, which is desirable; however, the density of the enamel slimes decreases also, which in turn is not desirable.

In order to maintain the water content in balance, additional enamel is present in an additional container 5, which is connected via the pipeline 9 with the pump 8 and the overflow means 4 and to the EIE-basin 2 in such a way that a good exchange of the enamel slimes is assured. The draining cells 6 are disposed in the additional basin 5 and ensure that as much water is withdrawn from the enamel slimes as is fed into it during the rinsing. If the size of the draining cells 6 is selected in such a way that the amount of water withdrawn is greater than the amount of water admitted above the EIE-basin 2, a density meter 10 installed in the pump circuit and a magnetic valve 12 jointly control the density in such a way that it remains constant in the EIE-basin 2 as well as in the additional basin 5.

In electric immersion enameling, the water passing into the coating electrodes, as the current is flowing, has to be definitely discarded because of the high conductivity (16000 uS/cm and higher), as the process would otherwise become unstable. Hence this water cannot be used for the spray nozzles of the spraying system 11.

The water withdrawn via the draining cells 6 (such water having a conductivity slightly higher than the one of the slimes) should be discarded as well, as a rule, so that the conductivity of the slimes in the coating basin is as low as possible. The lower the conductivity in the EIE-basin 2 the less problematic is the coating process. If the conductivity in the EIE-basin drops too much, this can be compensated during the rinsing of the parts by using a mixture of desalted water and drained water.

In another embodiment, instead of using a special additional basin 5 the battery of draining cells 6 can be arranged in an enlarged EIE-basin 2 without noticeably changing the basic process steps and device arrangements. In this way, the additional basin 5 can be dispensed with, if need be.

While only two embodiments of the present invention has been shown and described, it is to be understood that many changes and modifications may be made thereunto without departing from the spirit and scope of the invention.

What is claimed is:

1. A process for recovering the enamel slimes in electro-immersion enameling plants having a basin zone for electrophoretic immersion enameling (EIE-basin) of electro-immersion enameled parts and having an additional basin zone connected downstream in the process sequence, comprising at least partly spraying off the electro-immersion enameled parts above the EIE-basin zone or above the additional basin zone;

maintaining constant the water content of the EIE-basin by draining cell zones integrated in the EIE-basin zone or arranged in the additional zone and;

using desalted water for spraying.

2. A process as defined in claim 1, comprising completely spraying off the electro-immersion enameled parts.

3. A process as defined in claim 1, comprising using water with a determinable conductivity for spraying off the parts.

4. A process as defined in claim 1, comprising connecting at least one rinsing basin zone downstream of said additional basin zone.

* * * * *